United States Patent [19]

Trostle

[11] 4,424,655

[45] Jan. 10, 1984

[54] COMPENSATING CLIP FOR SIDING

[75] Inventor: John W. Trostle, Allison Park, Pa.

[73] Assignee: Aluminum Company of America, Pittsburgh, Pa.

[21] Appl. No.: 287,025

[22] Filed: Jul. 27, 1981

[51] Int. Cl.[3] ..... E04D 1/34; E04D 1/00

[52] U.S. Cl. ..... 52/520; 52/545; 52/547

[58] Field of Search ..... 52/520, 521, 529, 531, 52/543, 551, 276, 545, 547; 428/100, 99

[56] References Cited

U.S. PATENT DOCUMENTS

| | | | |
|---|---|---|---|
| 2,126,676 | 8/1938 | Thomas | 52/520 |
| 3,449,873 | 6/1969 | Damato | 52/211 |
| 3,473,274 | 10/1969 | Godes | 52/127 |
| 3,738,076 | 6/1973 | Kessler | 52/547 |
| 4,054,012 | 10/1977 | Paradisi | 52/276 |
| 4,079,562 | 3/1978 | Englert et al. | 52/545 |
| 4,096,679 | 6/1978 | Naz | 52/551 |
| 4,272,576 | 6/1981 | Britson | 52/551 |

FOREIGN PATENT DOCUMENTS

| | | | |
|---|---|---|---|
| 1055219 | 4/1959 | Fed. Rep. of Germany | 52/520 |

*Primary Examiner*—Reinaldo P. Machado
*Attorney, Agent, or Firm*—Max L. Williamson

[57] ABSTRACT

A siding panel system is provided including a clip device located between overlapping and interlocking siding panels to restrain movement of a horizontal siding panel which may become disengaged from an adjacent lower course of siding due to wood floor joist shrinkage in the vertical direction. The siding panels generally have a fastening portion along the upper edge and a longitudinal groove opening away from the upper edge on the panel face below the fastening portion. A hooked flange portion along the lower panel edge projects at an angle toward the panel back for engagement with the groove on the face of an adjacent panel. The clip device includes an upper fastening leg having a generally vertically elongated opening therethrough and an integral medial leg projecting downwardly from the terminal end of the fastening leg and outwardly from the building structure. An integral lower depending leg projects at an angle toward the back of the clip and toward the building structure from the terminal end of the medial leg. The clip includes a means for attaching the lower depending leg of the clip to the lower hooked flange portion of the lower course of siding panel to secure the siding panel to the building structure when panels are disengaged by relative vertical displacement of the panels. The compensating clip device may be individual clip members or an elongated strip form.

5 Claims, 3 Drawing Figures

COMPENSATING CLIP FOR SIDING

BACKGROUND OF THE INVENTION

This invention relates to siding panel systems for building structures. More particularly, this invention relates to a combination of horizontal siding panels and clip device for maintaining the integrity of the panel system by providing a means for keeping panels secured to the building structure when adjacent panels become disengaged due to the expansions and contractions of the building structure.

Many forms and shapes of interlocking and overlapping siding panels are widely used on new building structures and for recovering older buildings. Some forms of siding panels require the use of hook-shaped clips for attaching each siding panel to the building structure as shown in U.S. Pat. Nos. 2,820,535; 3,110,310 and 3,226,901. Other forms of siding panels are attached directly to the building structure by nailing along a top nailing edge of the siding panel. Such panels, also, generally provide some form of groove near the top edge which receives a complementary hook from the lower edge of an adjacent engaged panel. Generally, installation of such siding panels also includes the use of clips, such as starting clips or locking clips.

Once installed on a building, there is a tendency for the siding panels to display relative movement between the panels and between the panels and the building structure. Such relative movement is due to the normal expansions and contractions of building structures with age, weather variations and temperature changes, and is particularly prevalent in wooden structures wherein the wooden structural members tend to shrink with aging. Such expansion and contraction of the building structure may result in both horizontal and vertical relative movements. If siding panels are attached to building structures without permitting movement or compensation due to such expansions and contractions, then the siding panels may distort, buckle and bend.

U.S. Pat. Nos. 4,054,012 and 4,079,562 disclose the use of starting clips for maintaining a siding panel interlock while compensating for the relative movement between the panels and the building. Those patents disclose generally allowing relatively horizontal movement between the clips and the siding panel while maintaining the engagement of the starting clip with the siding panel. U.S. Pat. No. 4,096,679 also discloses a clip which allows for relative horizontal movement between the panels. Such devices, however, do not allow for the relative vertical movement between the siding panels due to the wood joist shrinkage and aging of the building structure. With regard to plastic siding, attempts have been made to compensate for the relative movement of the panels. U.S. Pat. No. 3,473,274 provides for a specially fabricated plastic sliding panel having an interlock which permits substantial bidirectional vertical movements between adjacent panels and between the first panel and the starter strip. U.S. Pat. No. 3,738,076 discloses nailing clips of special construction to provide that the siding is free to move slightly in the direction of its length relative to the wall.

There still exists a need to permit vertical relative movement due to the expansion rod contraction of the building structure and yet restrain siding panels by the use of clips or devices which can be easily and quickly attached to current panel designs without any special tools or other apparatus. It is desirable that a clip device be useful for several different designs or forms of siding panels and that it maintain the integrity of the panel system by restraining any siding panels which may become disengaged due to the relative vertical panel movement due to the expansion and contraction of the building structure and panels.

SUMMARY OF THE INVENTION

In accordance with the present invention, a clip device which can be easily manufactured is provided in combination with siding panels for securing the siding panels to the building structure. The clip device includes an upper fastening leg for attachment to the building wherein the leg has a generally vertically elongated opening therethrough. An integral medial leg projects downwardly from the terminal end of the fastening leg and outwardly from the face of the fastening leg. An integral lower depending leg projects at an acute angle from the face of the clip toward the back of the clip from the terminal end of the medial leg. The clip includes a means for attaching the lower depending leg of the clip to the lower hooked flange portion of a siding panel to secure the siding panel to the building structure when interlocked adjacent panels are disengaged by relative vertical displacement of the panels. The clip device may further include a return bend integral with the terminal end of the lower depending leg to prevent accidental engagement of the clip in the interlock between the panels. The clip device may also be provided in an elongated strip form for engagement with the siding panel along the length of the siding panel.

The clip device not only satisfies the objectives of the present invention in overcoming the problems in the prior art, but it is an easily manufactured device for maintaining the integrity and weather tightness of the panel system which is useful with a number of different forms and designs of siding panels. Another advantage of the present invention is that the clip device may be used at starter strip locations or at intermediate floor level locations on the side of the building structure.

DESCRIPTION OF THE PREFERRED EMBODIMENTS

Figure 1:
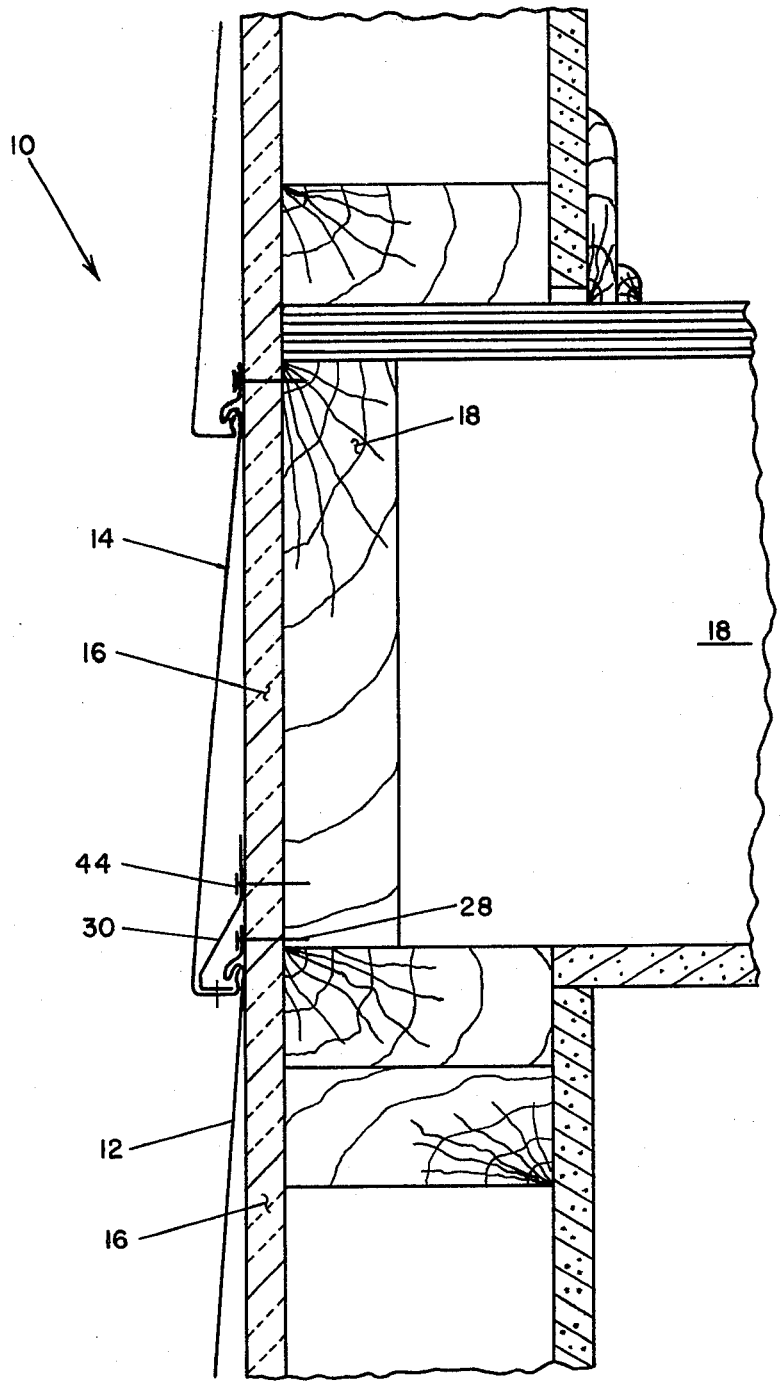
FIG. 1 is an elevation view in partial cross section of the combination of siding panel and clip device on the side of a building structure.

FIG. 1 illustrates in elevation view a horizontal siding panel system 10 secured to the side of a building wall structure and incorporating the present invention. Siding panel system 10 includes a lower source of siding panel 12 secured to the building wall structure sheathing 16 by nail 28 and an upper course siding panel 14 in overlapping and interlocking engagement with panel 12. At the interlock joint of siding panels 12 and 14, clip device 30 of the present invention is shown in its preferred form. FIG. 1 illustrates siding panel system 10 secured to the building structure at an intermediate floor level having an outer sheathing 16 and further showing wood joists 18 between the lower and upper floor levels.

In FIG. 1, siding panels 12 and 14 are shown generally having a fastening or nailing portion extending along the upper edge of the panel and a longitudinal hook receiving groove below the nailing portion on the panel face. The siding panels include a hooked flange portion along the lower panel edge projecting at an acute angle from the panel face toward the panel back (i.e. toward the building structure) for engagement with the groove on the face of an adjacent panel. FIG. 1 further illustrates that individual siding panels so attached to building structures may be secured to different wooden structural members of the building. The normal aging of the building structure, as well as temperature changes and weather variations and shrinkage of the wooden structural members, which cause expansion and contraction of the building structural members, tend to impose a relative vertical movement between each siding panel.

Figure 2:
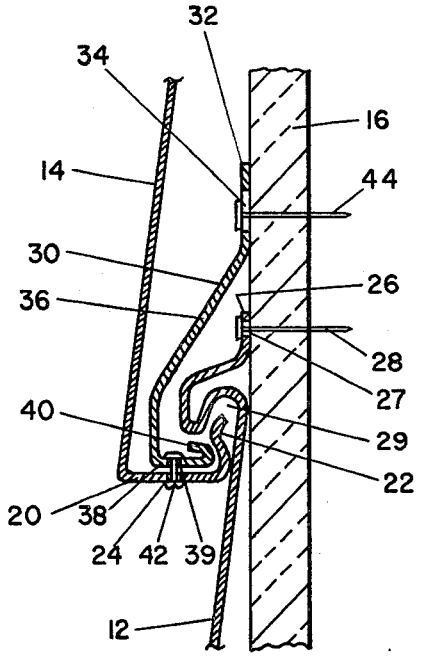
FIG. 2 is an enlarged view in cross section of a joint of FIG. 1.

FIG. 2 is an enlarged view in partial cross section of an overlapping interlocking joint of FIG. 1. Siding panels 12 and 14 are substantially identical in configuration. Siding panel 14 has a lower flange portion 20 projecting at an acute angle from the panel face toward the panel back and terminates in an upwardly projecting hook 22. Siding panel 12 has an upper nailing portion 26 which extends along the upper edge of the panel and has holes 27 therein for receiving fasteners. Below the nailing portion 26 and extending along the upper edge of siding panel 12 is a longitudinal hook receiving groove 29 opening away (downwardly in FIG. 2) from the upper edge on the panel face. Upper panel 14 engages with lower panel 12 when groove 29 of panel 12 receives hook 22 of panel 14 to form an overlapping and interlocking joint.

FIG. 2 further illustrates a preferred embodiment of clip device 30 installed in the overlapping interlocking joint of siding panels 12 and 14. Clip device 30 includes an upper fastening leg 32 having a generally vertically elongated opening or slot 34 therein. Upper leg 32 is a generally flat or planar member for contacting and lying flat against the building structure sheathing 16. An integral medial leg 16 projects downwardly from the terminal end of fastening leg 32, outwardly from the face of the fastening leg and outwardly from sheathing 16 of the building structure. The medial leg may take any of various forms; however, it must project outwardly sufficiently to overlie the interlock between hook 22 and groove 29 of the interlocked siding panels 12 and 14. An integral lower depending leg 38 projects at an acute angle from the face of clip 30 toward the back of the clip from the terminal end of medial leg 36. Leg 38 of clip 30 may extend substantially horizontally toward the back of the clip (toward the face of the building structure) or it may have some other form. It is important, however, that leg 38 contact the inner surfaces of the flange 20 of siding panel 14. Integral depending leg 38 may terminate in a reverse bend 40 integral with the terminal end of the lower depending leg 38. The return bend of the clip is used to prevent the lower course of siding from engaging in the horizontal lock.

Integral lower depending leg 38 of clip 30 also includes a means for attaching the lower depending leg to the lower flange portion 20 of siding panel 14. The means for attaching may include an opening or hole 39 in depending leg 38 of clip 30. As shown in FIG. 2, hole 39 of leg 38 registers with hole 24 of flange 20 of siding panel 14 and is joined by a fastener 42. Fastener 42 may be any of a variety of types of fasteners, such as sheet metal screws o-r pop rivets.

Clip 30 is attached to the building structure at the upper fastening leg 32 by fastener 44 passing through hole 34. Fastener 44 may be any of a variety of fasteners but generally would be a nail.

Figure 3:
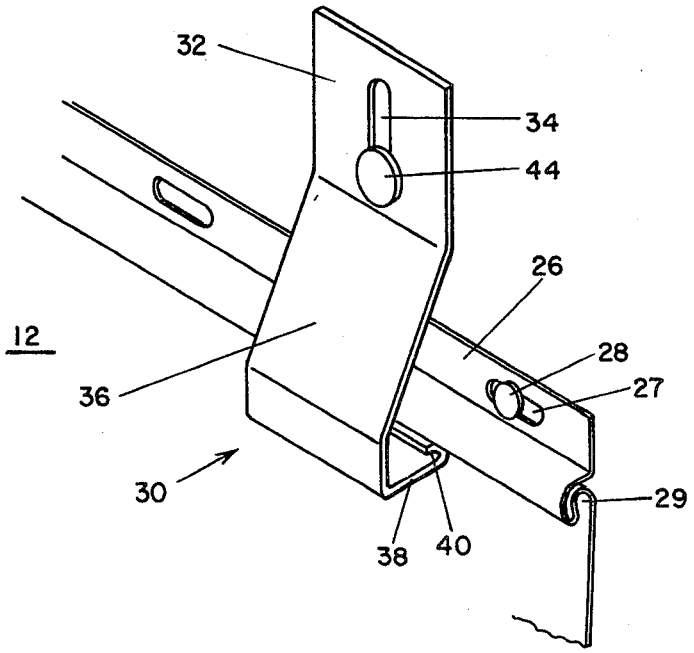
FIG. 3 is a perspective view of an installed clip device and siding panel.

Installation of siding panel system 10 on a building structure including the clip device of the present invention can be done easily and quickly without special tools or other apparatus. FIG. 3 is a perspective view illustrating clip device 30 and lower course siding panel 12 at a stage of partial installation. Generally, installation of siding panels 12 and 14 is done in a conventional manner. A lower course of siding, such as siding panel 12, can be installed on the building structure by securing upper nailing portion 26 of the panel to the building structure by nail 28 through nail slot 27. Clip device 30 then can be installed in an overlapping relationship such that integral medial leg 36 overlies the upper nailing portion 26 and groove 29 of siding panel 12. Integral lower depending leg 38 of clip 30 would contact the lower lip or edge portion of groove 29 of siding 12. In the preferred embodiment, leg 38 of clip 30 includes a reverse bend portion 40 which would contact the lower lip portion of groove 29 of siding 12. Clip 30 can be secured to the buidling structure by fastener 44, such as a nail, near the bottommost portion of elongated opening 34 in the upper fastening leg 32 of clip 30. A plurality of such clip devices 30 can be installed along the upper edge of a lower course of siding. In the alternative, clip device 30 may be in an elongated form such as to extend in an overlying relationship along the upper edge of a lower course of siding panel 12.

The next upper course of siding panel then can be installed in the customary fashion to overlie clip 30 and to interlock the hooked flange portion of the upper course of siding in the groove of the lower course of siding. After securing the upper course of siding to the building structure, a fastener 42, such as shown in FIG. 2, secures flange 20 of the upper course of siding to leg 38 of clip device 30.

Siding panel 14 and clip device 30 may each be provided with preformed holes, 24 and 39, respectively, for alignment at the lower edges thereof. Preferably, however, the siding panels and clip device would be installed on the building and holes 24 and 39 formed by simply drilling upwardly through lower flange 20 of siding panel 14 and through lower depending leg 38 of clip 30. Thereafter, fastener 42 can be inserted to join clip 30 to siding panel 14. During such drilling, clip 30 is restrained from movement upwardly away from siding flange 20 due to placement of fastener 44 at the bottom of slot 34.

With reference to FIG. 2, by nailing close to the bottom of nail slot 34 in clip 30, relative vertical movement of the siding, such as downward movement of siding panel 14, would tend to pull the clip 30 downwardly as the joist shrinks vertically due to the clip and siding attachment at their lower edges.

Clip device 30 of the present invention satisfies its objective to restrain horizontal siding panel which may become disengaged from an adjacent lower course due to wood joist shrinkage and the like. Furthermore, it maintains the weather tightness of the system by preventing the upper course of siding panel from moving away from the face of the building structure. The clip device is useful at starter strip locations or at intermediate floor levels where aging and resultant shrinking of wood joist members are most prevalent. The device can also be easily manufactured and is easily and quickly installed at field construction sites without any special tools or other apparatus.

Although preferred embodiments of the combination of siding panel and clip device of the present invention have been illustrated and described, it will be apparent to those skilled in the art that numerous changes and variations can be made therein without departing from the scope of the invention.

What is claimed is:

1. In combination with horizontal siding panels having a fastening portion along the upper edge, a longitudinal groove opening away from the upper edge on the panel face below the fastening portion, and a hooked flange portion along the lower panel edge projecting at an acute angle from the panel face toward the panel back for engagement with the groove on the face of an adjacent panel, a clip device comprising:

(a) an upper fastening leg for attachment to a building structure, said leg having a generally vertically elongated opening therethrough;

(b) an integral medial leg projecting downwardly from the terminal end of the fastening leg and outwardly from the face of the fastening leg;

(c) an integral lower depending leg projecting at an acute angle from the face of said clip toward the back of the clip from the terminal end of the medial leg;

(d) said clip overlying a first horizontal siding panel near the groove of the panel upper edge and underlying a second hoizontal siding panel near the lower panel edge;

(e) said clip including a fastening means for attaching the lower depending leg of said clip to the lower hooked flange portion of the second horizontal siding panel to secure the siding panel to the building structure when panels are disengaged by relative vertical displacement of the panels.

2. The combination as set forth in claim 1 wherein the clip device further includes a return bend integral with the terminal end of the lower depending leg.

3. The combination as set forth in claim 1 wherein the clip device is provided as an elongated strip.

4. The combination as set forth in claim 1 wherein the means for attaching the lower depending leg of the clip includes an opening aligned with an opening in the hooked flange of the siding panel for receiving a fastener for attaching the clip to the panel.

5. In combination with horizontal siding panels having a fastening portion along the upper edge, a longitudinal groove open inwardly of the upper edge on the panel face below the fastening portion, and a hooked flange portion along the lower panel edge projecting at an acute angle from the panel face toward the panel back for engagement with the groove on the face of an adjacent panel, a clip device for securing a siding panel to the building structure when adjacent panels are disengaged by relative vertical displacement of the panels, the clip device comprising:

(a) an upper fastening leg for attachment to a building structure, said leg having a generally vertically elongated opening therethrough;

(b) an integral medial leg projecting downwardly from the terminal end of the fastening leg and outwardly from the building structure;

(c) an integral lower depending leg projecting at an acute angle from the terminal end of the medial leg inwardly toward the building structure and terminating in an integral return bend;

(d) said clip overlying a first horizontal siding panel near the groove of the upper panel edge and underlying a second horizontal siding panel near the lower panel edge when the panels are in an overlapping groove and flange engagement;

(e) fastening means for attaching the lower depending leg of said clip to the lower hooked portion of the second horizontal panel.

* * * * *